US005950336A

United States Patent [19]

Liebl

[11] Patent Number: 5,950,336

[45] Date of Patent: Sep. 14, 1999

[54] REMOVABLE SNOWPLOW SYSTEM FOR AN ALL-TERRAIN VEHICLE

[76] Inventor: Kenneth A. Liebl, 859 Leatzow Rd., Three Lakes, Wis. 54562

[21] Appl. No.: 08/911,332

[22] Filed: Aug. 14, 1997

[51] Int. Cl.[6] ..... E01H 5/06

[52] U.S. Cl. ..... 37/231; 37/270

[58] Field of Search ..... 37/232, 231, 235, 37/266, 269, 270, 272, 273, 276, 281, 283, 903; 172/683, 684.5, 776, 811, 815, 824, 825

[56] References Cited

U.S. PATENT DOCUMENTS

| | | | |
|---|---|---|---|
| 1,661,158 | 3/1928 | Ball . | |
| 2,070,153 | 2/1937 | Brown | 37/44 |
| 2,299,451 | 10/1942 | Austin | 37/44 |
| 2,468,950 | 5/1949 | Wiedman | 37/42 |
| 2,642,294 | 6/1953 | Holm | 280/33.13 |
| 2,643,472 | 6/1953 | Merz | 37/144 |
| 3,012,345 | 12/1961 | Krueger | 37/42 |
| 3,157,099 | 11/1964 | Ulrich | 94/46 |
| 3,378,084 | 4/1968 | Ulrich | 172/247 |
| 3,432,949 | 3/1969 | Glesmann | 37/44 |
| 3,587,182 | 6/1971 | Airt | 37/270 X |
| 4,658,519 | 4/1987 | Quenzi | 37/23 |
| 4,907,358 | 3/1990 | Moore | 37/232 |
| 4,962,599 | 10/1990 | Harris | 37/266 |
| 5,081,775 | 1/1992 | Veilleux | 37/197 |
| 5,125,174 | 6/1992 | Watson et al. | 37/270 X |
| 5,127,175 | 7/1992 | Atkinson | 37/270 |
| 5,329,708 | 7/1994 | Segorski et al. | 37/231 |
| 5,485,690 | 1/1996 | MacQueen | 37/271 |
| 5,615,745 | 4/1997 | Cross | 37/270 X |

OTHER PUBLICATIONS

Electrak Linear Actuator Systems, Electrak 2, Warner Electric Brochure, P–786, Aug. 1994, p. 14.

All Terrain Vehicles, Polaris 196 Brochure, 1995.

*Primary Examiner*—Thomas B. Will

*Assistant Examiner*—Robert Pezzuto

*Attorney, Agent, or Firm*—Andrus, Sceales, Starke & Sawall

[57] ABSTRACT

A removable V-plow system for a vehicle includes both a push bar and an idler bar that are positioned and sized so that the vertical orientation of the plow blades with respect to the vehicle chassis remains fixed as the plow blades are raised and lowered. Raising and lowering of the plow blades is accomplished automatically by an operator-controlled actuator mechanism accessible to the driver of the vehicle that provides power to an electric actuator to raise and lower the plow. By maintaining a fixed orientation for the plow blades with respect to the vehicle chassis, down pressure can be evenly distributed along the bottom cutting edge of the V-plow onto the ground surface even when the plow is in a forward V, reverse V, or diagonal configuration. The plow includes a simplified trip mechanism, and a mounting system that facilitates convenient mounting and dismounting of the plow from the vehicle. The plow system and mounting system are designed to maintain clearance underneath the vehicle so that off-road capabilities are not hindered.

37 Claims, 5 Drawing Sheets

FIG. 1
(PRIOR ART)
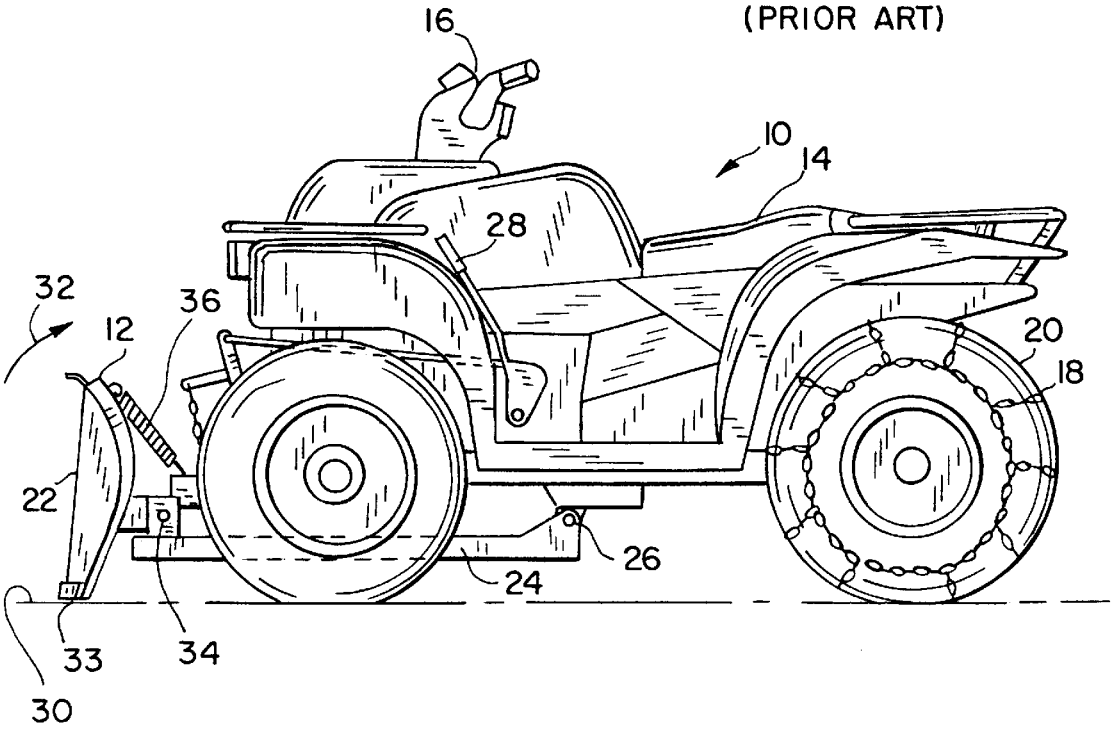
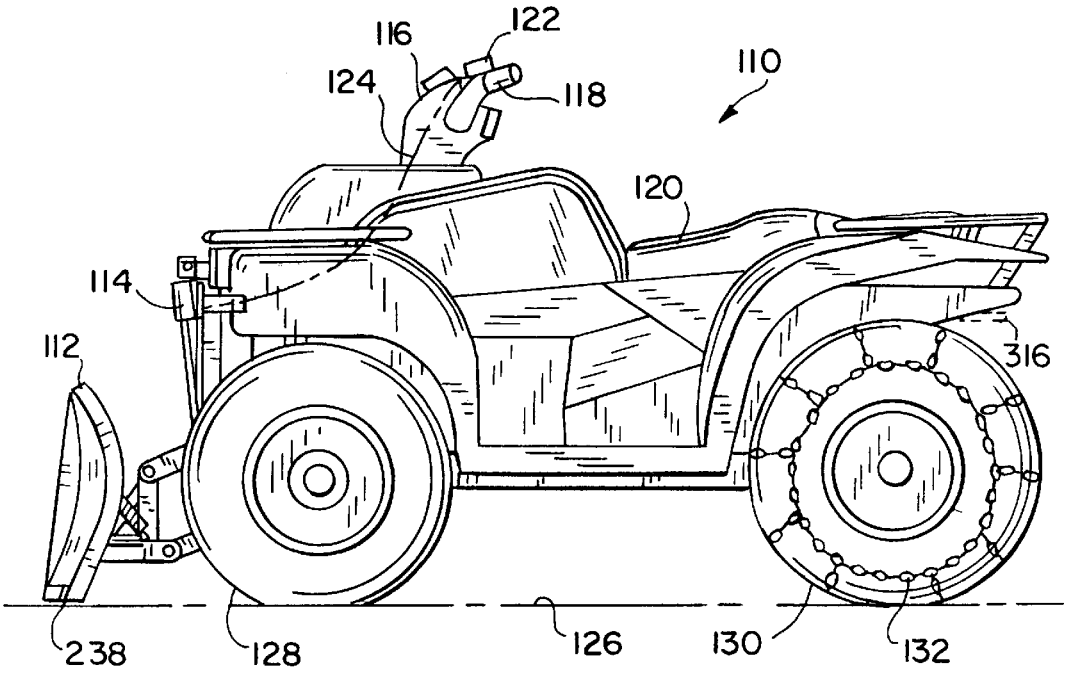
FIG. 2

FIG. 3
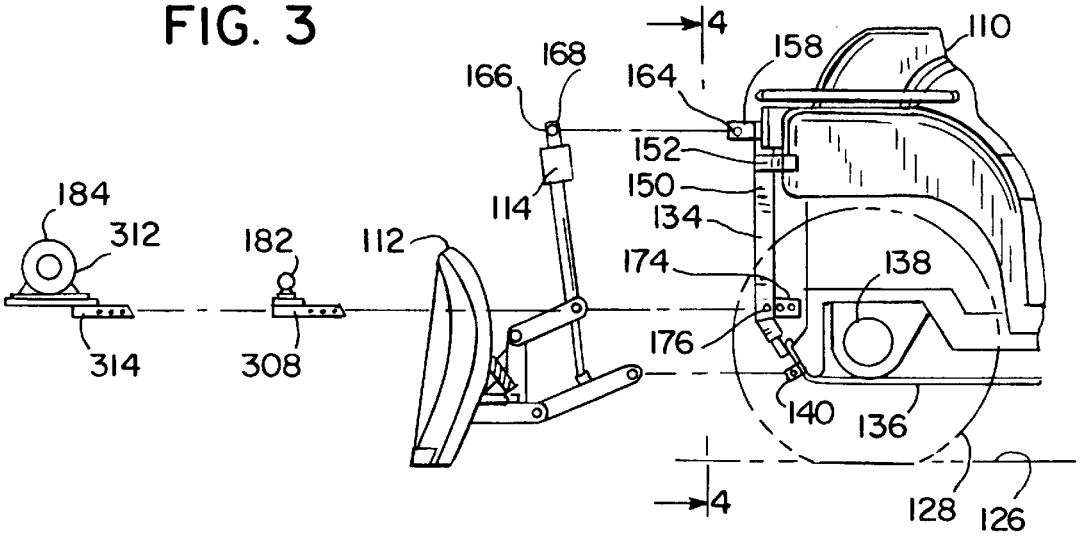
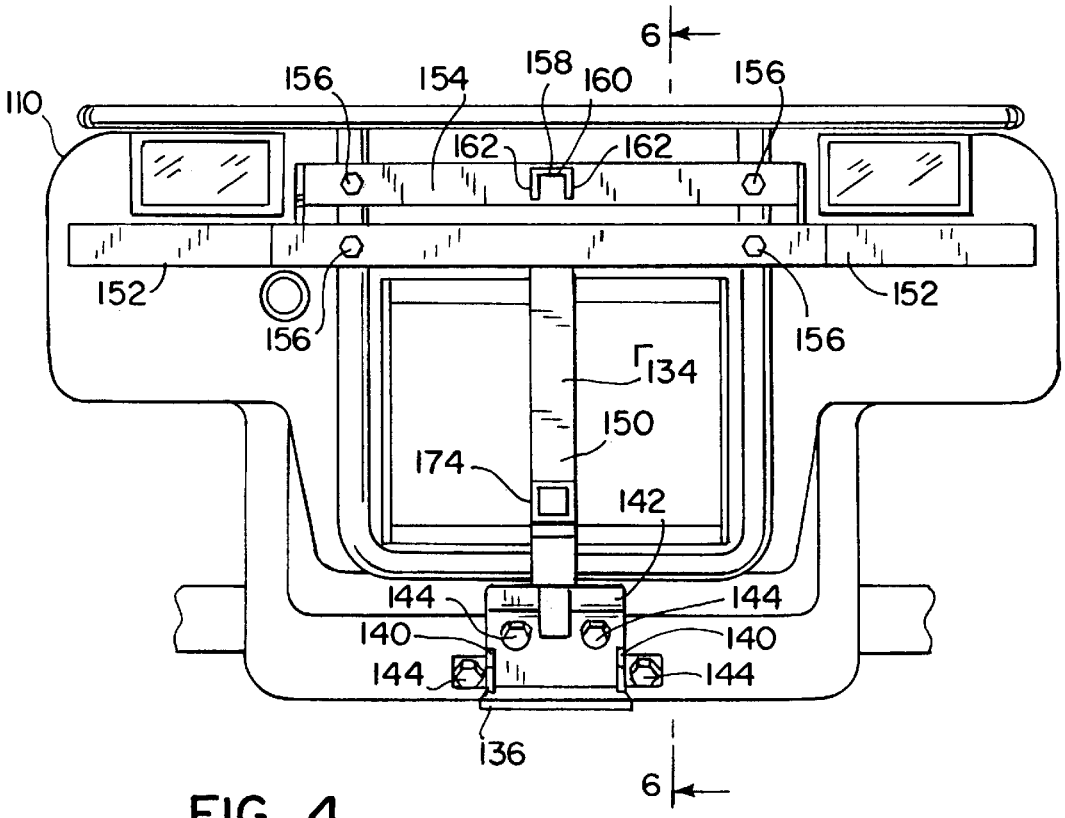
FIG. 4

FIG. 8
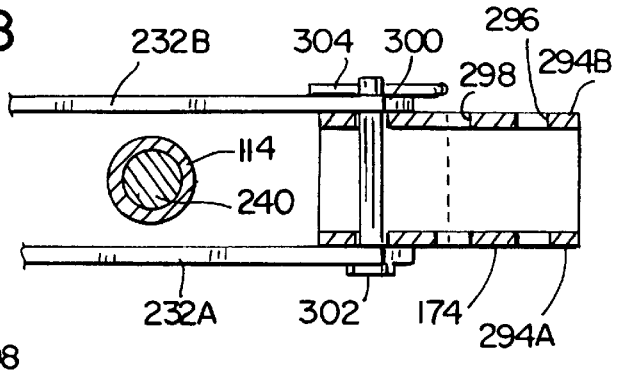
FIG. 9
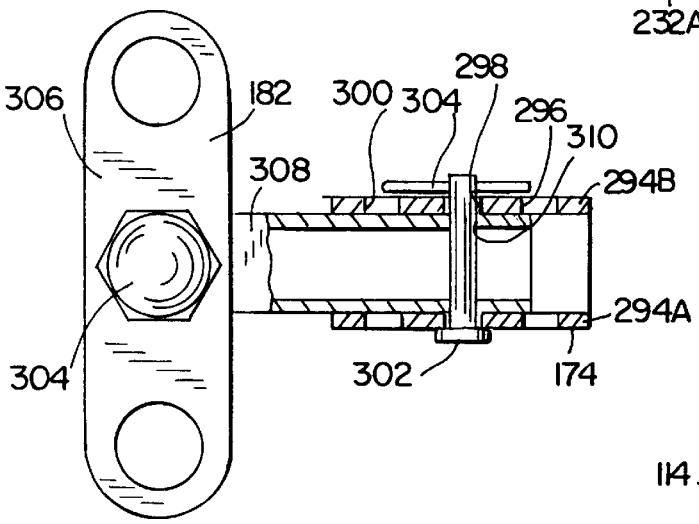
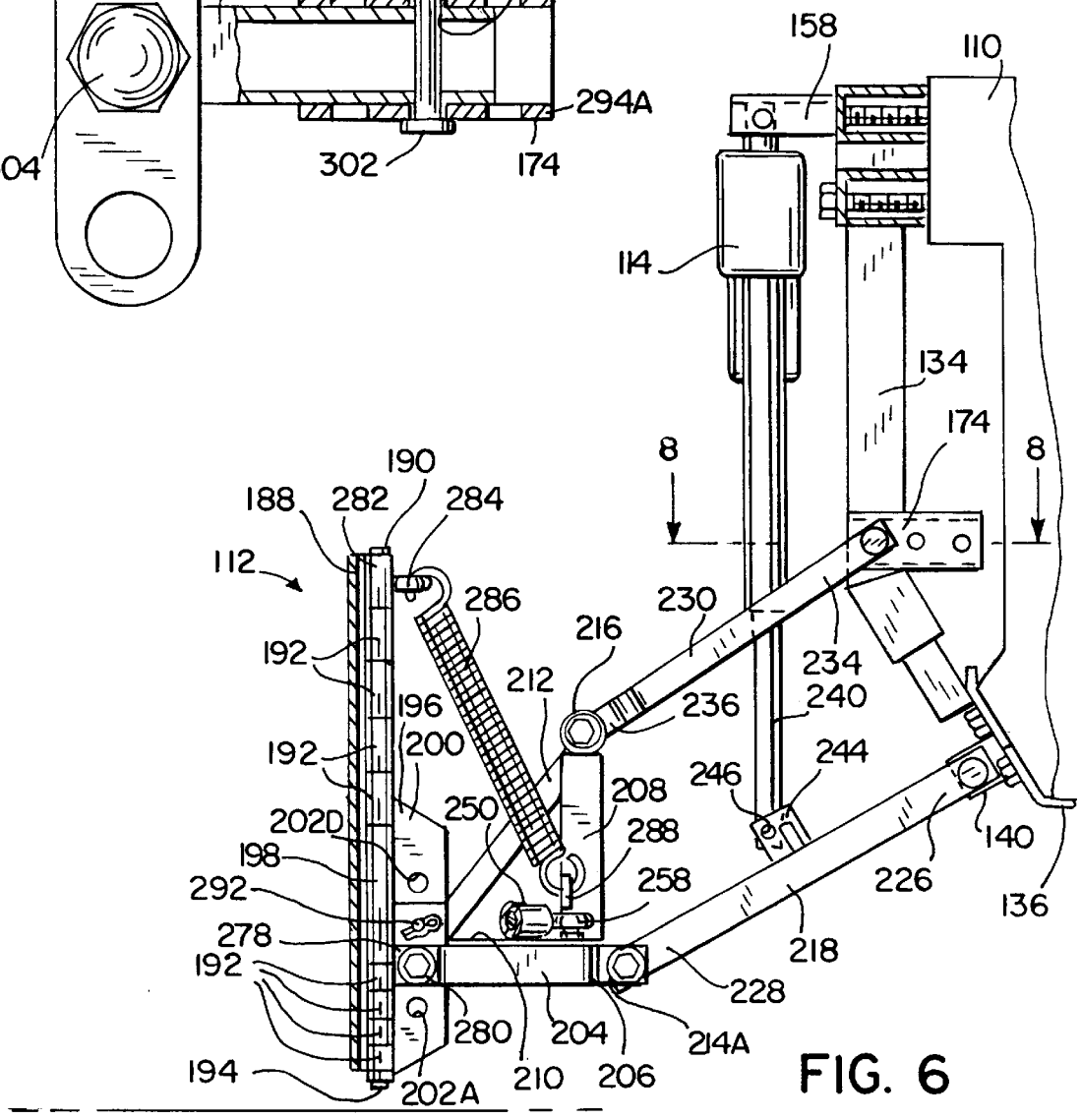
FIG. 6

FIG. 7
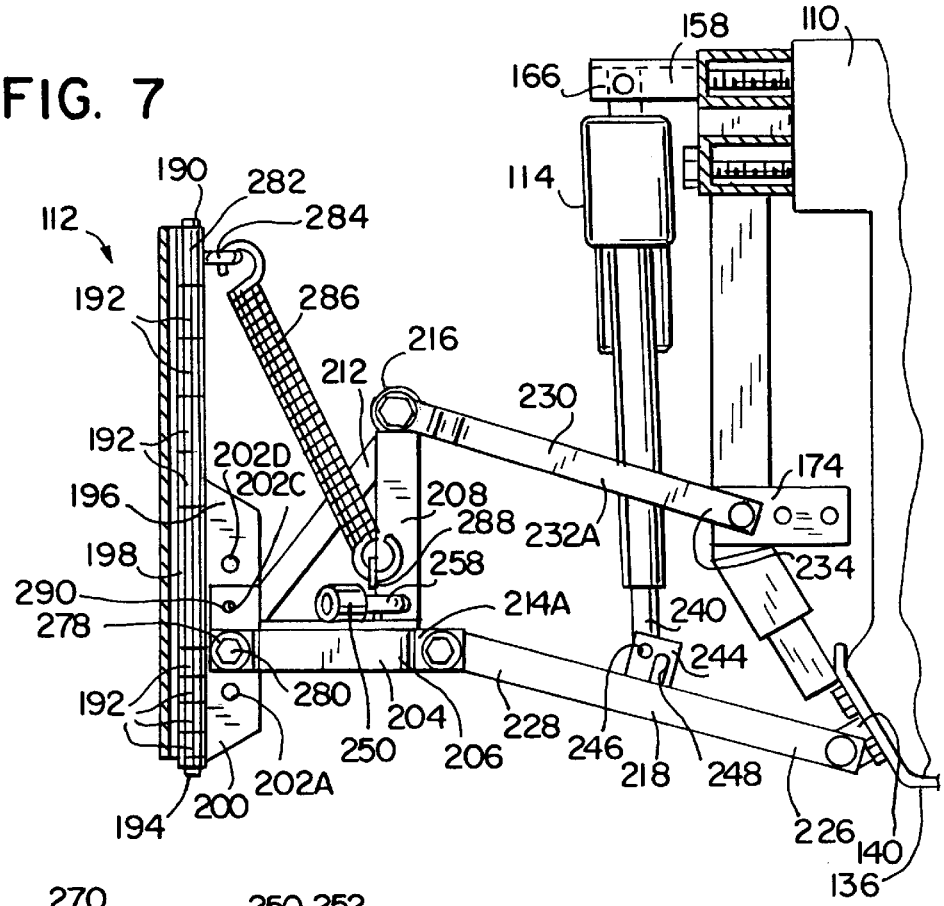
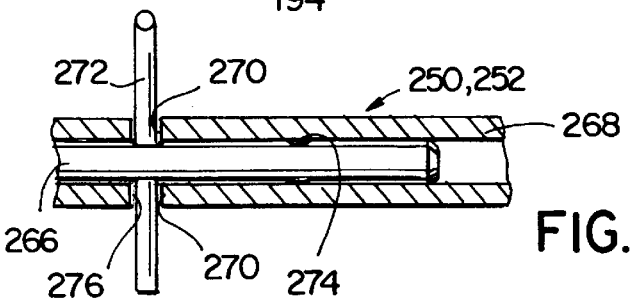
FIG. 11
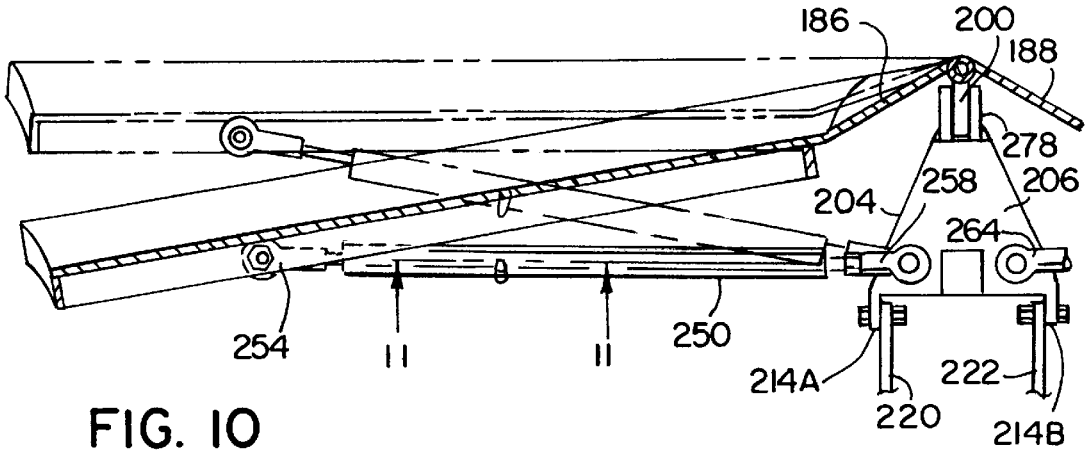
FIG. 10

REMOVABLE SNOWPLOW SYSTEM FOR AN ALL-TERRAIN VEHICLE

FIELD OF THE INVENTION

This invention is a removable snowplow system, preferably an adjustable V-plow system, that is particularly useful for use on all-terrain vehicles. The system includes several features that improve the effectiveness of the plow and make the plow more convenient to use.

BACKGROUND OF THE INVENTION

It is widely known to use snowplows on all-terrain vehicles. FIG. 1 shows a conventional all-terrain vehicle 10 having a snowplow 12 attached to the chassis of the all-terrain vehicle 10. To drive the all-terrain vehicle 10, a driver sits on seat 14 and steers the vehicle 10 using a steering assembly 16. Chains 18 are often used on the rear wheels 20 of the all-terrain vehicle 10 to improve traction, which is usually needed so that the vehicle 10 can provide sufficient thrust for snowplowing.

The plow 12 shown in FIG. 1 has a straight, concave plow blade 22. Hinged adjustable V-blade plow systems that include a pair of plow blades connected along a vertical hinge are also quite common. Such a V-blade plow system is disclosed in U.S. Pat. No. 5,329,708 entitled "Universal Off Road Vehicle Snowplow" by Segorski et al., issued Jul. 19, 1994.

In either the straight blade plow shown in FIG. 1 or the V-blade plow shown in U.S. Pat. No. 5,329,708, the plow blade is mounted to the vehicle 10 using a heavy duty pivotable frame 24 that hangs underneath the chassis of the vehicle 10. The pivotable frame 24 attaches generally below the mid point of the vehicle 10 at pivot point 26. This configuration keeps the front end of the vehicle 10 from becoming too heavy to be practical for satisfactory operation. A mechanical operating lever 28 is provided to lift the blade 22 off of the ground 30 by rotating the blade 22 about pivot point 26 generally in the direction of arrow 32. The mechanical operating lever 28 is located so that a driver sitting on the seat 14 of the vehicle 10 can access the mechanical lever 28 by leaning forward. Partly due to the amount of room available for the plow frame 24, and partly due to cant incurred by the plow blade 22, the plow blade 22 cannot typically be raised more than 2 or 3 inches off of the ground when the plow blade 22 is lifted in the direction of arrow 32.

It is normally desirable that a bottom cutting edge 33 of the plow blade 22 be aligned or flush with the ground surface 30 when plowing. A trip mechanism is often provided to allow the plow blade 22 to pivot about pivot point 34 against the force of spring 36 upon encountering an obstacle. Above referenced U.S. Pat. No. 5,329,708 discloses a trip mechanism for a V-plow system. However, with the trip mechanism in U.S. Pat. No. 5,329,708, the height of the plow blade when it is in the full-down position cannot be adjusted.

The plow systems shown in FIG. 1 and shown in U.S. Pat. No. 5,329,708 have several drawbacks. First, the systems are manually operated and many plow users lack the strength, energy or desire to manipulate the plow blade. In addition, the systems are generally difficult to mount and remove from the all-terrain vehicle. Thus, most users mount the plow to the all-terrain vehicle at the beginning of the winter plow season and do not remove the plow until the end of the winter plow season. With the plow installed, the vehicle 10 is virtually useless as an all-terrain vehicle. There is very little clearance under the bottom cutting edge of the plow blade even when the blade is completely lifted. There is also very little clearance under the chassis of the vehicle 10 due to the frame 24. Further, the weight of the plow substantially alters the maneuverability of the all-terrain vehicle 10.

Another drawback of these systems is that many all-terrain vehicles are relatively light (e.g., lighter all-terrain vehicles range from about 450 lbs. to 600 lbs. in total weight not including the weight of the plow), and therefore all-terrain vehicles are often underpowered for moving large quantities of snow.

Another disadvantage with the V-plow systems such as shown in U.S. Pat. No. 5,329,708 is that it is difficult to maintain the bottom cutting edge of the plow blade flush with the ground surface unless the plow 12 is precisely mounted on the vehicle 10, and the plow blades 22 are accurately positioned to align the bottom cutting edge flush with the ground. If one wishes to apply down pressure from the V-plow onto the ground, the bottom cutting edge of the V-plow does not in general remain flush with the ground surface when rotated downward. Thus, it is difficult or even impossible to provide evenly distributed down pressure.

BRIEF SUMMARY OF THE INVENTION

The invention is an automatic snowplow system that is convenient to use and convenient to mount and dismount from the vehicle. The system is especially well-suited to improve the effectiveness of an adjustable V-plow on all-terrain vehicles. The snowplow system includes several features that improve the effectiveness of the plow, and enhance the maneuverability of the all-terrain vehicle when the plow is mounted.

In one aspect, the plow system includes both a push bar and an idler bar pivotally secured to mounts on the vehicle. The idler bar is generally parallel to the push bar and is preferably mounted at a location higher than the push bar. The plow system includes a plow frame structure that is mounted to the ends of the push bar and the idler bar. At least one plow blade is mounted to the front end of the plow frame structure. A lift mechanism, preferably an automatic electric actuator, raises and lowers the plow blade with respect to the chassis of the vehicle, by moving the push bar pivotally around the vehicle push bar mount. The idler bar and the push bar are sized and positioned so that the plow blade remains in a generally fixed orientation with respect to the vehicle chassis as the lift mechanism moves through a full range of motion. This configuration has several advantages. First, it is possible to mount the plow blade relatively close to the front of the vehicle chassis because the plow blade does not cant towards the vehicle as the blade is raised and lowered. Second, the configuration is extremely useful in a V-plow system because the bottom cutting edge of plow blades in a V-plow system remain aligned or parallel with the ground whether the plow blades are in a full-down position, in a partial-down position, or in a full-up position. This is particularly useful when it is desired to apply down pressure with the plow blades against the ground surface. Since the plow blade does not rotate to apply down pressure, the down pressure remains evenly distributed along the bottom cutting edge of the plow blade. In another aspect, the invention relates to a chassis mounting bracket that is affixed to the chassis of the vehicle, and provides for convenient mounting and dismounting of the plow to the vehicle. In particular, the chassis mounting bracket includes a flat, generally horizontal skid plate that extends from the front of the vehicle rearward underneath the chassis of the vehicle.

The attachment of the skid plate to the vehicle underchassis, along with the attachment of other portions of the chassis mounting bracket to the vehicle, are sufficient to securely mount the plow to the vehicle. The skid plate does not hang down underneath the vehicle, and thus does not hinder off-road capabilities when either the plow is dismounted, or the plow is raised. In order to optimize the clearance under the vehicle, it is desirable that the vehicle push bar mount be located above the height of the horizontal skid plate.

In the preferred embodiment of the invention, the chassis mounting bracket also includes a vehicle idler bar mount and a lift mechanism mount. The vehicle idler bar mount is preferably configured as a tubular receiver that can accommodate a removable trailer hitch or removable winch when the plow is dismounted from the vehicle. It is further preferred that an identical tubular receiver be mounted on the rear of the vehicle to accommodate a removable trailer hitch or removable winch at the rear of the vehicle.

In yet another aspect, the invention is a simplified trip mechanism for a plow system, preferably a V-plow system. The pair of plow blades for the V-plow are connected along a vertical hinge and are pivotally mounted to the plow frame structure for rotation about a horizontal trip mechanism axis. A freely rotatable hinge collar is mounted around a vertical hinge pin for the vertical plow hinge at a location higher than the horizontal trip mechanism axis (i.e., at a location higher than the location that the plow blades are pivotally mounted to the plow frame structure). A spring is connected between the freely rotatable hinge collar and the plow frame structure to prevent rotation of the plow blades about the horizontal trip mechanism axis unless the plow blades encounter an obstacle in which case the blades rotate against the force of the springs. In order to adjust the configuration of the V-plow blades about the vertical hinge, the system is provided with first and second plow angle adjustment arms connected between the rear side of respective plow blades and the plow frame structure. Since the point of connection for the plow angle adjustment arms to the plow frame structure is behind the horizontal trip mechanism axis, the plow angle adjustment arms must be capable of three dimensional rotation in order to accommodate the trip mechanism. This is preferably carried out by providing ball joints to the ends of the plow angle adjustment arms.

The preferred V-plow system has a vertical hinge bracket along the vertical hinge between the pair of plow blades. The vertical hinge bracket has a flange containing a series of holes, preferably four. The V-plow blades are pivotally mounted to the plow frame structure about the horizontal trip mechanism axis using a bolt or the like passing through the plow frame structure and through one of the holes in the flange. The nominal height of the V-plows can be adjusted by selecting a different hole in the vertical hinge bracket flange to mount the V-plow. In addition, the trip mechanism can be easily deactivated by placing a pin through another hole in the flange to act as a stop for the trip mechanism.

Other features and advantages of the invention should be apparent to those skilled in the art upon inspecting the drawings and the following description thereof.

BRIEF DESCRIPTION OF THE DRAWINGS

FIG. 1 is a side elevational view of an all-terrain vehicle having a prior art snowplow system.

FIG. 2 is a side view of an all-terrain vehicle having a removable snowplow system in accordance with the invention mounted thereto.

FIG. 3 is an exploded side view showing the removable snowplow system of FIG. 2 along with other components dismounted from the front end of an all-terrain vehicle.

FIG. 4 is a view taken along line 4—4 in FIG. 3.

FIG. 6 is a side view of the removable snowplow system shown in FIG. 5 taken along lines 6—6 in FIG. 4.

FIG. 7 is a view similar to FIG. 6 showing plow blades in the removable snowplow system in a raised position.

FIG. 8 is a sectional view taken along lines 8—8 in FIG. 6.

FIG. 9 is a view similar to FIG. 8 illustrating a trailer hitch removably mounted in a tubular receiver.

FIG. 10 is a top view of a portion of the removable snowplow system shown in FIG. 5.

FIG. 11 is a detailed sectional view taken along lines 11—11 in FIG. 10.

DETAILED DESCRIPTION OF THE DRAWINGS

Figure 5:
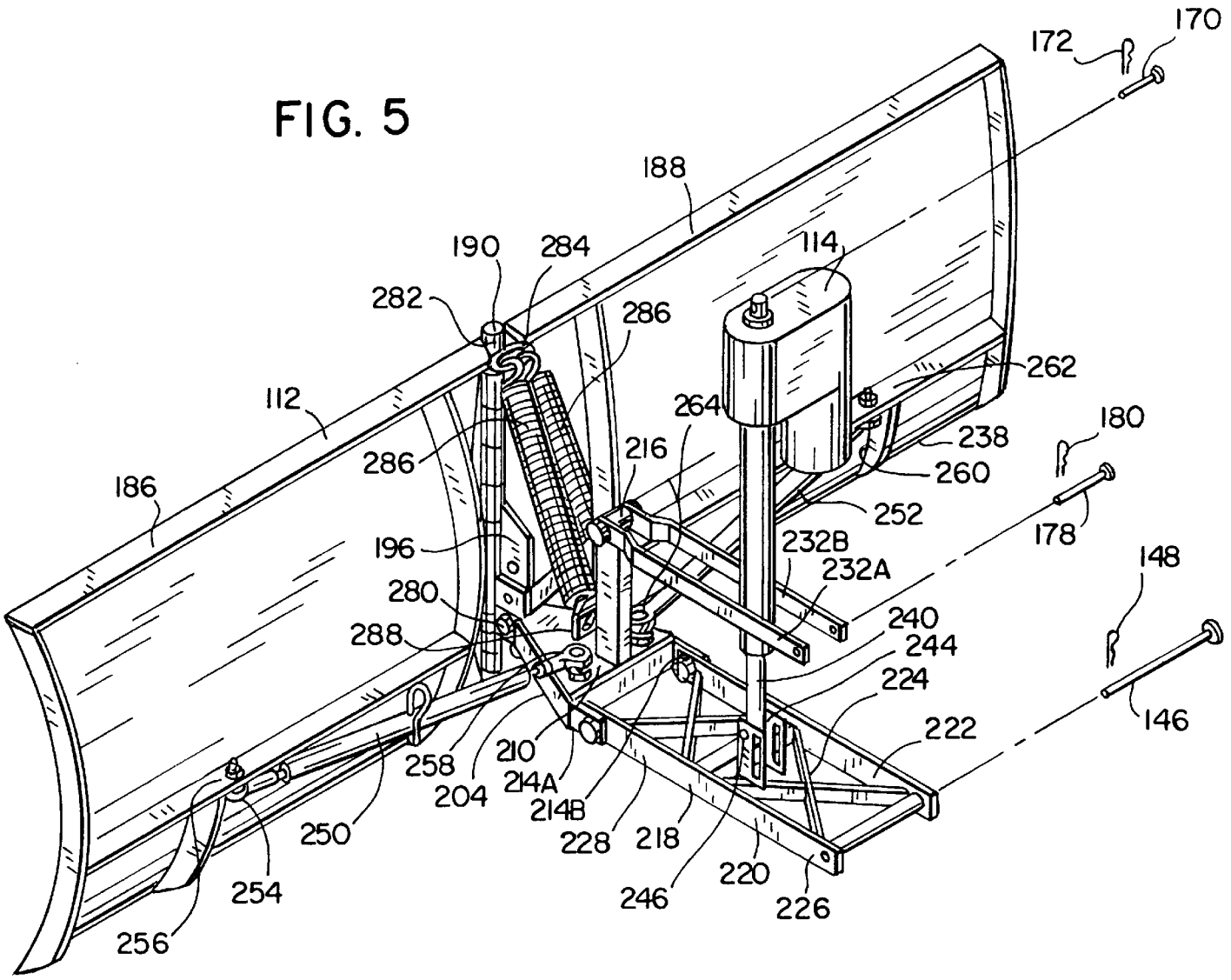
FIG. 5 is a rear perspective view of a removable V-plow system in accordance with the invention.

FIG. 2 shows a conventional all-terrain vehicle 110 having a snowplow 112 with an automatic lift mechanism 114. The all-terrain vehicle 110 has a steering assembly 116 having handlebars 118. The all-terrain vehicle 110 also has a seat 120 located rearward of the steering assembly 116. When a driver sits on seat 120 to steer the all-terrain vehicle 110, the driver can easily access an automatic actuator control mechanism 122 mounted on the handlebar 118. The automatic actuator control mechanism 122 is electrically connected to the lift mechanism 114 as indicated by dash line 124. The raising and lowering of the plow 112 can be accomplished automatically by a driver on the all-terrain vehicle 110 using the automatic actuator control mechanism 122 on the handlebar 118.

The all-terrain vehicle 110 is supported on the ground 126 by a pair of front wheels 128 and a pair of rear wheels 130. It is common to use chains 132 on the rear wheels 130 to improve traction for the all-terrain vehicle 110 so that the all-terrain vehicle can provide sufficient thrust for snowplowing.

Referring to FIGS. 3 and 4, the plow 112 and the lift mechanism 114 are removably mounted to a chassis mounting bracket 134 attached to the chassis of the all-terrain vehicle 110. The chassis mounting bracket 134 includes a flat, generally horizontal skid plate 136 that extends from the front of the vehicle 110 rearward underneath the chassis of the vehicle 110. The horizontal skid plate 136 preferably extends rearward underneath a front axle 138 of the vehicle, and is attached to the underside of the vehicle chassis 110 approximately 20 inches rearward of the front of the chassis. The skid plate 136 is made of stock steel and has a preferred thickness of between ¼ to ½ of an inch. The primary purpose of the skid plate 136 is to provide secure mounting of the chassis mounting bracket 134 to the vehicle 110, however, the skid plate 136 also provides protection to the underside of the vehicle chassis. The skid plate 136 does not significantly affect clearance between the vehicle 110 and the ground 126, and thus does not hinder off-road capabilities of the all-terrain vehicle. This is especially true when the plow 112 is dismounted from the vehicle 110.

The chassis mounting bracket 134 also includes a pair of push bar mounts 140. The push bar mounts 140 consist of tabs containing a hole. The tabs are welded onto a front portion of the skid plate 136 that is bent to angle upwards as the skid plate 136 extends forward at the front of the vehicle chassis. The push bar mounts 140 on the chassis mounting bracket 134 is located no lower than the skid plate 136. The upwardly bent portion 142 of the skid plate 136 is shown in FIG. 4 to be attached to the vehicle chassis with bolt 144. A push bar mounting pin 146, FIG. 5, is used to pivotally mount the plow 112 to the push bar mounts 140. A removable snap pin 148, FIG. 5, is used to secure the push bar mounting pin 146 in place when the plow 112 is mounted to the vehicle 110.

Referring still to FIGS. 3 and 4, the chassis mounting bracket 134 includes a vertical mast 150 that extends upward from the skid plate 136. A horizontal bumper 152 is connected to the top end of the mast 150. The bumper 152 is connected or integral with a lift mechanism support beam 154. The bumper 152 and the lift mechanism support beam 154 are mounted to the vehicle chassis using bolts 156. The chassis mounting bracket 134 is thus securely mounted to the chassis of the all-terrain vehicle 10 by mounting the bumper 152 and the lift mechanism support beam 154 at the upper end of the chassis mounting bracket 134 to the vehicle chassis, and by fastening the skid plate 136 at the lower end of the chassis mounting bracket 134 to the lower front end of the vehicle chassis and also to the underchassis of the vehicle (not shown). The lift mechanism support beam 154 includes a lift mechanism mount 158, which preferably extends perpendicularly forward of the lift mechanism support beam 154. The lift mechanism mount 158 has a horizontal wall 160 and two vertical walls 162 extending downward from the horizontal wall 160. Each of the vertical walls 162 contains a mounting hole 164. A top end 166 of the lift mechanism 114 contains a mounting hole 168. A lift mechanism mounting pin 170, FIG. 5, is used to removably mount the top end 166 of the lift mechanism 114 to the lift mount 158. To do this, the lift mechanism mounting pin 170 is passed through mounting holes 164 in the lift mount 158 on the vehicle 110 and also through mounting hole 168 at the top end 166 of the lift mechanism 114. A snap pin 172, FIG. 5, is removably attached to the lift mechanism mounting pin 170 to secure the pin 170.

Referring still to FIGS. 3 and 4, the chassis mounting bracket 134 has a tubular receiver 174 connected to the mast 150 of the chassis mounting bracket 134. As shown in FIG. 3, the tubular receiver 174 serves as an idler bar mount. The receiver 174 has a generally rectangular cross-section, preferably a square cross-section. As shown in FIG. 3, the horizontal walls of the tubular receiver 174 contain mounting holes 176. Mounting pin 178, FIG. 5, is used to pivotally secure the plow 112 to the idler bar mount 174. A removable snap pin 180, FIG. 5, is used to secure the removable mounting pin 178 in the idler bar mount 174 when the plow 112 is mounted to the vehicle 110. When the plow 112 is dismounted from the vehicle 110, the receiver 174 can be used to removably mount other mechanisms to the vehicle 110, such as a trailer hitch 182, or a winch 184.

From the foregoing description, it should be apparent that once the chassis mounting bracket 134 is secured to the vehicle 110, the installation of the plow 112 onto the vehicle 110 can be accomplished with the insertion of only three removable mounting pins 146, 170, 178. Further, the mounting locations for the removable mounting pins 146, 170 and 178 are easily accessible from the front of the vehicle 110, and there is no need to climb under the vehicle 110 to mount or dismount the plow 112 to the chassis mounting bracket 134.

Although the drawings show each of the mounts 140, 174, and 158, along with the mast 152 and the skid plate 136 as part of an integral chassis mounting bracket 134, it is not necessary that these components be part of an integral component to carry out the invention. In many applications, it is difficult or even impossible to provide these mounts on a single integral component. Thus, it should be recognized that the chassis mounting bracket 134 shown in the drawings is merely exemplary, and should not limit the scope of the invention.

Referring now to FIGS. 5–7, the plow 112 is preferably a V-plow system having a first plow blade 186 and a second plow blade 188. Each plow blade 186, 188 is preferably concave with respect to a horizontal axis, and generally straight along the axis for a length of about 30 inches. The plow blades 186 and 188 are connected along a vertical hinge 190. The position of the plow blades 186, 188 can be set relative to the vertical hinge 190 so that the plow blades form a straight plow face as shown in FIG. 5, or so that the plow blades form a forward V-plow configuration, a reverse V-plow configuration, a diagonal configuration, or any variant thereof.

Each plow blade 186, 188 includes hinge collar elements 192 that pivotally secure the respective blade 186, 188 to a vertical hinge pin 194. A vertical hinge mounting bracket 196 is also mounted to the vertical hinge pin 194. The vertical hinge mounting bracket 196 includes an elongated hinge collar 198 and a vertical flange 200. The vertical flange 200 on the vertical hinge mounting bracket 196 contains a series of mounting holes 202A, 202B, 202C, and 202D.

The vertical hinge bracket 196 is pivotally mounted to a plow frame structure 204 about a horizontal trip mechanism axis (i.e. about bolt 280). The plow frame structure 204 includes a horizontal A-frame structure 206, and a tower 208. The A-frame structure includes a platform 210 mounted on a reinforced support structure. The tower 208 extends perpendicularly upward from the platform 210. A reinforcement buttress 212, FIGS. 6 and 7, can be used if necessary to support the tower 208. The plow frame structure 204 includes a pair of push bar mounts 214A, 214B located near the base of the tower 208. The top of the tower 208 contains an idler bar mount 216.

A push bar structure 218 and an idler bar structure 230 are used to mount the plow frame structure 204 to the vehicle chassis mounting bracket 134. The push bar structure 218 includes two push bars 220, 222 along with a cross-support structure 224. A first end 226 of the push bar structure 218 is pivotally secured to the vehicle push bar mount 140 on the vehicle 110, and a second end 228 of the push bar structure 218 is mounted to the push bar mounts 214A, 214B on the plow frame structure 204.

The idler bar structure 230 includes two spaced apart idler bars 232A, 232B. A first end 234 of the idler bar structure 230 is pivotally secured to the idler bar mount 174 on the vehicle 110. A second end 236 on the idler bar structure 230 is pivotally secured to the idler bar mount 216 on the top of the tower 208 of the plow frame structure 204. In the specific embodiment of the invention shown in FIGS. 5–7, the length of the push bars 220, 222 between the mounts 214, 140 is approximately 13 ¾ inches. The length of the idler bars 232A, 232B between the mounts 216, 174 is slightly shorter, for instance about 10 inches. It is preferred that the vehicle idler bar mount 174 be located at a height above the vehicle push bar mount 140 that is substantially equal to the height of the idler bar mount 216 on the top of the tower 208 of the plow frame structure 204 above the push bar mount 214A, 214B on the A-frame 206 of the plow frame structure 204. While the specific dimensions of the push bars 220, 222 and the idler bars 232A, 232B are not critical to carrying out the invention, the relative lengths of the bars 220, 222, 232A and 232B along with the relative positions of the mounts 140, 214A, 214B, 174 and 216 are chosen so that the plow blades 186, 188 remain in a generally fixed orientation with respect to the vehicle chassis 110 as the idler bar structure 230 and the push bar structure 218 pivot about the respective mounts 174, 140 on the vehicle 110. This can be seen by comparing FIGS. 6 and 7. FIG. 6 shows the plow 112 in a down position, and FIG. 7 shows the plow 112 in an up position. Due to the size and mounting locations of the push bar structure 218 and the idler bar structure 230, the plow 112 remains substantially vertical with respect to the vehicle 110 as the plow 112 is raised and lowered between the down position, FIG. 6 and the up position, FIG. 7. Maintaining the vertical orientation of the plow blades 186, 188 is especially important when the plow blades 186, 188 are adjusted in a forward V configuration, a reverse V configuration, a diagonal configuration, or a variant thereof. When the blades 186, 188 are so adjusted, maintaining the vertical orientation of the blades 186, 188 maintains alignment of the bottom cutting edge 238, FIGS. 2 and 5, with the ground 126 even when the plow 112 is in a partial-down position. Further, the bottom cutting edge 238 of the plow blades 186, 188 maintains alignment when the plow 112 is put in a full-down position so that pressure is evenly distributed when the bottom cutting edge 238 applies down pressure on the ground 126 surface.

Another advantage of maintaining the vertical orientation of the plow blades 186, 188 when the plow 112 is raised and lowered is that the plow blades 186, 188 can be mounted closer to the vehicle 110 without limiting the lifting range of the plow blades 186, 188 even when the plow blades are in a V or diagonal configuration. The ability to mount the plow 112 closer to the front end of the all-terrain vehicle 110 improves the stability of the all-terrain vehicle 110 when the plow 112 is mounted thereto. Note that the linear range of the lift mechanism 114 should be sufficient to lift the bottom cutting edge 238 of the plow blades 186, 188 above the height of the main portion of the skid plate 136. The ability to lift the plow blades 186, 188 above the height of the skid plate 136 even when the plow blades are in a V or diagonal configuration significantly improves the maneuverability of the all-terrain vehicle 110 when the plow is mounted to the all-terrain vehicle.

The lift mechanism 114 is preferably an electric DC linear actuator. A suitable linear actuator is manufactured by Warner Electric, South Beloit, Ill., Electrak 2. The electric actuator is powered by 12 volts DC power. The actuator 114 should be weather protected. The automatic actuator control mechanism 122 on the handlebar 118 is wired to the battery for the all-terrain vehicle 110, and provides power through power line 124 to the lift mechanism 114 to raise or lower the plow 112. The actuator 114 has an actuator arm 240 that is connected to the push bar structure 218. The preferred linear stroke length of the actuator arm 240 is 8 inches in the embodiment of the invention shown in the drawings. The lifting range of the plow blades 186, 188 shown in the drawings is approximately 15–17 inches.

The actuator 114 should have sufficient lifting capacity and range of motion to lower the plow blades 186, 188 against the ground so that the bottom cutting edge 238 of the plow blades 186, 188 provides downward pressure against the ground 126 to at least partially unweight the front wheels 128 on the vehicle 110. For the all-terrain vehicle 110 shown in the drawings, the preferred lift mechanism 114 has a lifting capacity of 500 lbs. Unweighting the front wheels 128 puts more weight on the rear wheels 130, and enhances the use of the chains 132 and thus vehicle traction.

The actuator 114 is mounted so that the actuator cylinder/actuator arm 240 pass between the separated idler bars 232A, 232B. Note that the actuator arm mounting bracket 244 is centered across the push bar structure 218. In addition, the A-frame structure 206 on the plow frame structure 204 allows the push bar mounts 214A, 214B to be spaced apart approximately 6 inches. The balanced application of force by the actuator arm 240 on the push bar structure 218, along with the relatively wide distance between the push bar mounts 214A, 214B provides a stable and rugged construction for the plow mechanism.

The actuator arm 240 contains an actuator arm mounting hole at its lower end. The push bar structure 218 includes an actuator arm mount 244. The actuator arm mount 244 is connected to cross-supports 224 for the push bar structure 218. The actuator arm mount 244 includes a pair of pin holes 246 and a pair of vertical slots 248. An actuator pin 246 is used to mount the actuator arm 240 to the pin holes 246 on the actuator arm mount 244 and provide a fixed mount for the actuator 114 to the push bar structure 218. The pin 246 is removable, and can also be used to secure the actuator arm 240 within the vertical slots 248 of the actuator arm mount 244 to provide a floating mount for the actuator 114 to the push bar frame 218.

Although it is preferred that the actuator arm 240 be mounted solely to the push bar structure 218, the invention should not be limited to the configuration shown in the drawings. For instance, it may be desirable in some circumstances that the actuator arm 240 be directly mounted to arms or the like in the location of the idler arms 232A, 232B, and consequently provide idler arms in a location corresponding to the location of the push bar structure 218. On the other hand, in some applications it may be desirable to drive both the push bar structure 218 and the idler bars 232A, 232B with an actuator.

Referring now to FIGS. 5, 10 and 11, the plow includes a first plow angle adjustment arm 250 and a second plow angle adjustment arm 252. The length of both the first plow angle adjustment arm 250 and the second plow angle adjustment arm 252 can be incrementally adjusted, thereby changing the configuration of the plow blades 186, 188 such as between a forward-V configuration, a diagonal configuration, a straight configuration, a reverse-V configuration or any incremental variant thereof. The first plow angle adjustment arm 250 has a first end 254 connected to the rear side 256 of the first plow blade 186. The connection is preferably a ball joint connection, and in any event should be able to accommodate three dimensional rotation between the first plow angle adjustment arm 250 and the rear side 256 of the first plow blade 186. The second end 258 of the first plow angle adjustment arm 250 is connected to the plow frame structure 204, and in particular to a mount on the mounting surface 210 of the A-frame 206. The connection is preferably a ball joint, and in any event should be able to accommodate three dimensional rotation between the first plow angle adjustment arm 250 and the plow frame structure 204. The second plow angle adjustment arm 252 has a first end 260 that is connected to the rear side 262 of the second plow blade 188. The connection is preferably a ball joint, but in any event should be able to accommodate three dimensional rotation between the second plow angle adjustment arm 252 and the rear side 262 of the second plow blade 188. The second plow angle adjustment arm 252 has a second end 264 that is connected to the plow frame structure 204. Again, the connection is preferably a ball joint, but in any event should be able to accommodate three dimensional rotation between the second plow angle adjustment arm 252 and the plow frame structure 204.

As shown in FIG. 11, the preferred configuration for the plow angle adjustment arms 250, 252 is a tube-in-tube configuration. FIG. 11 illustrates an inner tube 266 that is connected to the first end 254, 260 of the respective plow angle adjustment arm 250, 252, and also illustrates an outer tube 268 that is connected to the second end 258, 264 of the respective plow angle adjustment arm 250, 252. The outer tube 268 includes a setting hole 270 therethrough that is sized to receive pin 272. The inner tube 266 is slidably mounted within the outer tube 268. The inner tube 266 includes several, preferably five, position setting holes such as illustrated by reference numbers 274 and 276. The length of the plow angle adjustment arms 250, 252 is incrementally adjusted by sliding the inner tube 266 within the outer tube 268 until position setting holes such as 274, 276 in the inner tube 266 align with the holes 270 in the outer tube 268. The pin 272 is inserted to selectively fix the length of the plow angle adjustment arm 250, 252.

Referring now to FIGS. 5, 6, 7 and 10, a front portion 278 of the A-frame structure 206 of the plow frame structure 204 contains a trip mechanism hole (i.e. corresponding to mounting bolt 280). Mounting bolt 280 is secured through the trip mechanism mounting hole on the front portion 278 of the plow frame structure 204, and also through one of the series of holes 202A, 202B, 202C, 202D on the vertical hinge bracket flange 200 to pivotally secure the plow blades 186, 188 to the plow frame structure 204. FIGS. 6 and 7 show trip mechanism bolt 280 secured through hole 202B on the vertical hinge bracket flange 200. The bolt 280 defines the horizontal trip mechanism axis. When the plow blades 186, 188 encounter an obstacle, the plow blades 186, 188 rotate horizontally with respect to the plow frame structure 204 about the bolt 280 (i.e., rotation about the horizontal trip mechanism axis).

A freely rotatable collar 282 is secured around the hinge pin 194 for the vertical hinge 190 at a location above the mounting bolt 280. The freely rotatable collar 282 is integral with a spring attachment eyelet 284. Two heavy-duty springs 286 are connected between a respective eyelet 288 on the plow frame structure 204 and the eyelet 284 integral with the freely rotatable collar 282. The springs 286 maintain the plow blades 186, 188 in a vertical orientation with respect to the plow frame structure 204 until the plow blades 186, 188 encounter an obstacle. If the blades 186, 188 encounter an obstacle, the blades rotate about the horizontal trip mechanism axes (e.g. bolt 280) against the force of the springs 286. After the obstacle has been passed, the springs 286 pull the plow blades 186, 188 back to the vertical position. Note that the support buttress 212 along with the A-frame structure 206 is configured to provide a rotational stop for the vertical hinge bracket flange 200 to prevent overrotating of the plow blades 186, 188 beyond a vertical orientation due to the returning force of the springs 286. For proper operation of the trip mechanism, however, a stop should not be provided for rotating the vertical hinge bracket 196 and the plow blades 186, 188 in the counter-clockwise direction about the horizontal trip mechanism axis (e.g. bolt 280). In the embodiment of the invention shown in FIGS. 6 and 7, the vertical hinge bracket 196 has a rotational range of motion ranging from vertical counter-clockwise about 85°.

The front portion 278 of the plow frame structure 204 also includes a trip mechanism deactivation hole 290, FIG. 7, which is located above the location of the mounting bolt 280. FIG. 6 illustrates a trip mechanism locking pin 292 that can be inserted through the hole 290 in the front portion 278 of the plow frame structure 204 and also through the flange hole 202B, 202C, or 202D directly above the flange hole 202A, 202B, 202C in which the mounting bolt 280 is secured. When the pin 292 is installed, the V-plow trip mechanism is deactivated because pivotal motion of the V-plow 112 with respect to the plow frame structure 204 about the horizontal trip mechanism axis 280 is prevented.

In addition to providing means for deactivating the V-plow trip mechanism, the presence of a plurality of holes 202A, 202B, 202C, and 202D on the vertical hinge flange 200 allows the relative height of the plow blades 186, 188 with respect to the plow frame structure 204 to be easily adjusted by removing bolt 280 and resecuring the bolt 280 through another one of the holes 202A, 202B, 202C, or 202D. This feature allows the plow 112 to be adjusted to alternative vehicles 110 and/or applications.

Note that the plow angle adjustment arms 250, 252 have a first end connected to the rear side 256, 262 of the respective plow blade 186, 188, which is located on one side of the horizontal trip mechanism axis (e.g. bolt 280); and have a second end 258, 264 connected to the plow frame structure 204 which is located on the other side of the horizontal trip mechanism axis (e.g. bolt 280). In order to accommodate relative rotation between the plow blades 186, 188 and the plow frame structure 204 when the plow blades 186, 188 trip upon encountering an obstacle, the ends of the plow angle adjustment arms 250, 252 are designed to accommodate three dimensional rotation. Three dimensional rotation of the plow angle adjustment arms 250, 252 also allows for the capability to adjust the height of the plow blades 186, 188 with respect to the plow frame structure 204.

Compared to other trip mechanisms, the horizontal trip mechanism pivot axis 280 is particularly close to the vertical hinge 190 and/or rear side of the plow blades 186, 188. Tripping the plow blades 186, 188 is therefore less cumbersome than with other designs. Thus, providing the ability of three dimensional rotation of the plow angle adjustment arms 250, 252 allows the trip mechanism axis 280 to be located forward of the location where the plow angle adjustment arms 250, 252 connect to the plow frame structure 204, and thus allows the plow 112 to have a more compact design. This feature helps to keep the plow blades 186, 188 in relatively close proximity of the front end of the all-terrain vehicle 110.

Referring now to FIGS. 3, 8 and 9, as previously described, it is preferred that the idler bar mount 174 consist of a tubular receiver 174 having a rectangular or square cross-section. As shown in FIG. 8, the horizontal walls 294A, 294B of the receiver 174 contain three sets 296, 298 and 300 of aligned mounting holes. The idler bars 232A, 232B are preferably pivotally secured to the tubular receiver 174 using a pin 302 passing through the ends of the idler bars 332A, 332B and also through the outermost set 300 of aligned holes in the vertical walls 294A, 294B of the tubular receiver 174. A cotter pin or the like 304 is used to secure the pivot pin 302 in place.

When the plow 112 is removed from the vehicle 110, a trailer hitch 182 or a winch 184 can be mounted to the tubular receiver 174. Referring to FIG. 9, the trailer hitch 182 includes a trailer hitch ball 304 and a hitch bracket 306 mounted to a hitch mounting body 308. The hitch mounting body 308 has a rectangular cross-section and can be removably inserted into the tubular receiver 174 so that the hitch mounting body 308 nests snugly within the tubular receiver 174. The hitch mounting body 308 includes a set of horizontal mounting holes 310 that can be selectively aligned with one of the sets of mounting holes 296, 298, 300 in the vertical walls 294A, 294B of the tubular receiver 174. Preferably, the hitch mounting body 308 should be inserted deep enough into the receiver 174 so that the hitch 182 is rigidly fixed to the vehicle 110. The pin 302 and cotter pin 304 are used to removably secure the hitch mounting body 308 within the tubular receiver 174.

Alternatively, FIG. 3 shows that a winch 184 can be removably mounted into the tubular receiver 174. In FIG. 3, the winch assembly 184 includes a winch 312 and a winch mounting body 314. The winch mounting body 314 is similar to the hitch mounting body 308, and the winch 184 is removably mounted to the tubular receiver 174 in the same manner as the hitch 182 is removably mounted to the tubular receiver 174.

It may be desirable to mount a rear tubular receiver 316, FIG. 2, to the rear of the all-terrain vehicle 110. The rear tubular receiver 316 should have a rectangular cross-section with the same dimensions as the front tubular receiver 174 so that the trailer hitch 182 and the winch 184 can be mounted within the rear tubular receiver 316.

The invention as described above with respect to FIGS. 2-11 is the preferred embodiment of the invention. Various alternatives, modifications or equivalents may be apparent to those skilled in the art. The following claims should be interpreted to include such alternatives, modifications or equivalents.

I claim:

1. A plow system for a vehicle comprising:

a plow frame structure having a push bar mount and an idler bar mount that is located at a different height on the plow frame structure than the push bar mount;

at least one plow blade mounted to the plow frame structure;

a vehicle push bar mount connected to a chassis of the vehicle;

a vehicle idler bar mount connected to a chassis of the vehicle and located at different height with respect to the vehicle than the vehicle push bar mount;

a push bar having a first end pivotally secured to the vehicle push bar mount and a second end pivotally secured to the push bar mount on the plow frame structure;

an idler bar having a first end pivotally secured to the vehicle idler bar mount and a second end pivotally secured to the idler bar mount on the plow frame structure; and a lift mechanism that moves the push bar pivotally around the vehicle push bar mount, thereby moving the plow blade with respect to the chassis of the vehicle;

wherein the plow system is a V-plow system in which a first plow blade is connected to a second plow blade along a vertical hinge.

2. The plow system as recited in claim 1 wherein the vehicle idler bar mount is located at a height above the vehicle push bar mount which is equal to the height at which the idler bar mount on the plow frame structure is located above the push bar mount on the plow frame structure.

3. The plow system as recited in claim 1 wherein the V-plow system further comprises:

a first plow angle adjustment arm having a first end connected to a rear side of the first plow blade and a second end connected to the plow frame structure; and a second plow angle adjustment arm having a first end connected to a rear side of the second plow blade and a second end connected to the plow frame structure.

4. A plow system as recited in claim 3 wherein the vertical hinge includes a first hinge collar attached to the first plow blade, a second hinge collar attached to the second plow blade, and a third hinge collar attached to a vertical hinge bracket, and wherein the plow frame structure includes a generally horizontal bracket pivotally attached to the vertical hinge bracket for rotation about a horizontal trip mechanism axis, and the second end of the first and the second plow angle adjustment arms are connected to the generally horizontal bracket.

5. A plow system as recited in claim 4 wherein:

the vertical hinge bracket includes a flange having a series of vertically spaced holes therethrough; and the generally horizontal bracket includes at least one mounting hole for pivotally attaching the horizontal bracket to one of the mounting holes in the vertical hinge bracket flange.

6. A plow system as recited in claim 5 wherein:

the plow frame structure further includes a second hole, and a removable pin can engage the second hole in the plow frame structure and one of the holes on the vertical hinge bracket flange to prevent pivotal motion of the first and second plow blade with respect to the plow frame structure.

7. A plow system as recited in claim 3 wherein:

the connection between the first end of the first plow angle adjustment arm and the rear side of the first plow blade accommodates three dimensional rotation;

the connection between the second end of the first plow angle adjustment arm and the plow frame structure accommodates three dimensional rotation;

the connection between the first end of the second plow angle adjustment arm and the rear side of the second plow blade accommodates three dimensional rotation; and the connection between the second end of the second plow angle adjustment arm and the plow frame structure accommodates three dimensional rotation.

8. A plow system as recited in claim 3 wherein:

the connection between the first end of the first plow angle adjustment arm and the rear side of the first plow blade is a ball joint;

the connection between the second end of the first plow angle adjustment arm and the plow frame structure is a ball joint;

the connection between the first end of the second plow angle adjustment arm and the rear side of the second plow blade is a ball joint; and the connection between the second end of the second plow angle adjustment arm and the plow frame structure is a ball joint.

9. A plow system as recited in claim 3 wherein the length of the first plow angle adjustment arm can be adjusted incrementally, and the length of the second plow angle adjustment arm can be adjusted incrementally.

10. A plow system as recited in claim 1 wherein the first plow blade and the second plow blade are connected along the vertical hinge to form a V-plow that is pivotally mounted to the plow frame structure for rotation about a horizontal trip mechanism axis, and the system further comprises:

a V-plow trip mechanism including a freely rotatable collar mounted around a hinge pin for the vertical V-plow hinge at a location higher than the horizontal trip mechanism axis; and a spring connected between the plow frame structure and the freely rotatable collar.

11. A plow system as recited in claim 10 wherein:

the vertical V-plow hinge includes a vertical hinge bracket having a mounting flange containing a hole therethrough;

the plow frame structure includes a hole corresponding to the hole in the flange; and the V-plow system further includes a removable pin that can engage the hole in the plow frame structure and the hole in the vertical hinge bracket flange to deactivate the V-plow trip mechanism by preventing pivotal motion of the V-plow with respect to the plow frame structure about the horizontal trip mechanism axis.

12. A plow system as recited in claim 1 wherein the vehicle idler bar mount connected to the vehicle chassis comprises:

a tubular receiver having a rectangular cross-section mounted to the vehicle chassis; and when the plow is dismounted from the vehicle, a removable mounting body having a rectangular cross-section that can be inserted into the tubular receiver and held in place with a pin passing through the tubular receiver and the removable mounting body.

13. A plow system as recited in claim 12 further comprising:

a removable trailer hitch including a trailer hitch ball mounted to a hitch mounting body having a rectangular cross-section that can be inserted into the tubular receiver and held in place with a pin passing through the tubular receiver and the hitch mounting body.

14. A plow system as recited in claim 12 further comprising:

a removable winch assembly including a winch and a winch mounting body having a rectangular cross-section that can be inserted into the tubular receiver and held in place with a pin passing through the tubular receiver and the winch mounting body.

15. A plow system as recited in claim 1 wherein the idler bar and the push bar are sized and positioned so that the plow blade remains in a generally fixed orientation with respect to the vehicle chassis as the lift mechanism moves through a full range of motion.

16. A plow system as recited in claim 1 wherein the lift mechanism has a range of motion that is sufficient to lift a bottom cutting edge of the plow blade to a height above the vehicle push bar mount.

17. A plow system as recited in claim 1 wherein the vehicle is an all-terrain vehicle.

18. A plow system as recited in claim 1 wherein the vehicle push bar mount is part of a chassis mounting bracket that includes a flat, horizontal skid plate extending from the front of the vehicle rearward underneath the chassis of the vehicle.

19. A plow system as recited in claim 18 wherein the push bar mount is located at a height no lower than the skid plate.

20. A plow system as recited in claim 18 wherein the vehicle idler bar mount is also included on the chassis mounting bracket.

21. A plow system as recited in claim 1 wherein:

the lift mechanism is removably mounted to a lift mechanism mount on the vehicle chassis;

the vehicle idler bar is removably mounted to the vehicle idler bar mount on the vehicle chassis; and the vehicle push bar is removably mounted to the vehicle push bar mount on the vehicle chassis.

22. A plow system as recited in claim 19 wherein the vehicle further comprises:

a rear tubular receiver mounted on the rear of the vehicle, the rear tubular receiver having a rectangular cross-section having the same dimensions as the front tubular receiver.

23. A V-plow system for a vehicle comprising:

a plow frame structure having a push bar mount;

a pair of plow blades connected along a vertical hinge and pivotally mounted to the plow frame structure at a plow blade mounting location for rotation about a horizontal trip mechanism;

a vehicle push bar mount connected to a chassis of the vehicle;

a push bar having a first end pivotally secured to the vehicle push bar mount and a second end pivotally secured to the push bar mount on the plow frame structure;

a trip mechanism including a freely rotatable hinge collar mounted around a hinge pin for the vertical plow hinge at a location higher than the plow blade mounting location, and a spring connected between the plow frame structure and the freely rotatable hinge collar to prevent rotation of the plow blades about the horizontal trip mechanism axis unless the plow blades encounter an obstacle;

a first plow angle adjustment arm having a first end connected to a rear side of the first plow blade and a second end connected to the plow frame structure; and a second plow angle adjustment arm having a first end connected to a rear side of the second plow blade and a second end connected to the plow frame structure;

wherein the connection between the first end of the first plow angle adjustment arm and the rear side of the first plow blade accommodates three dimensional rotation;

the connection between the second end of the first plow angle adjustment arm and the plow frame structure accommodates three dimensional rotation;

the connection between the first end of the second plow angle adjustment arm and the rear side of the second plow blade accommodates three dimensional rotation; and the connection between the second end of the second plow angle adjustment arm and the rear side of the second plow blade accommodates three dimensional rotation.

24. A V-plow system as recited in claim 23 further including a vertical hinge bracket connected to the pair of plow blades, the vertical hinge bracket having a flange containing a series of mounting holes, thereby enabling the vertical hinge bracket to be selectively mounted to the plow frame structure so that the height of the plow blades with respect to the plow frame structure can be adjusted.

25. A V-plow system as recited in claim 23 wherein:

the connection between the first end of the first plow angle adjustment arm and the rear side of the first plow blade is a ball joint;

the connection between the second end of the first plow angle adjustment arm and the plow frame structure is a ball joint;

the connection between the first end of the second plow angle adjustment arm and the rear side of the second plow blade is a ball joint; and the connection between the second end of the second plow angle adjustment arm and the rear side of the second plow blade is a ball joint.

26. A V-plow system as recited in claim 23 wherein the length of the first plow angle adjustment arm can be adjusted incrementally, and the angle of the second plow angle adjustment arm can be adjusted incrementally.

27. A removable snowplow system for an all-terrain vehicle comprising:

a plow frame structure having a push bar mount;

at least one plow blade mounted to the plow frame structure;

a chassis mounting bracket mounted to the chassis of the all-terrain vehicle, the chassis mounting bracket including a flat, generally horizontal skid plate extending from the front of the vehicle rearward underneath the chassis of the vehicle and a vehicle push bar mount that is located no lower than the skid plate;

a push bar removably attached to the chassis mounting bracket, the push bar having a first end pivotally secured to the vehicle push bar mount on the chassis mounting bracket and a second end pivotally secured to the push bar mount on the plow frame structure;

a vehicle idler bar mount connected to a chassis of the vehicle and located at a different height with respect to the vehicle than the vehicle push bar mount;

an idler bar having a first end pivotally secured to the vehicle idler bar mount and a second end pivotally secured to the idler bar mount on the plow frame structure; and a lift mechanism that moves the push bar pivotally around the vehicle push bar mount, thereby moving the plow blade with respect to the chassis of the vehicle.

28. A removable snowplow system as recited in claim 27 wherein the idler bar and the push bar are sized and positioned so that the plow blade remains in a generally fixed orientation with respect to the vehicle chassis as the idler bar and the push bar pivot about the respective mounts on the vehicle.

29. A removable snowplow system as recited in claim 27 wherein the lift mechanism has a range of motion that is sufficient to raise the plow blade so that a bottom cutting edge of the plow blade is at a height above the vehicle push bar mount on the chassis mounting bracket.

30. A removable snowplow system as recited in claim 27 wherein the lift mechanism has a range of motion that is sufficient to lower the plow blade so that a bottom cutting edge of the plow blade pushes against the ground on which the vehicle is supported with sufficient downward pressure to at least partially unweight front wheels on the vehicle and transfer weight of the vehicle to rear wheels on the vehicle.

31. A plow system for an all terrain vehicle comprising:

a plow frame structure having a push bar mount, an idler bar mount that is located at a different height on the plow frame structure than the push bar mount and a plow blade mounting location that is in alignment with a horizontal trip axis;

at least one plow blade mounted to the plow frame structure at the plow blade mounting location for pivotal rotation about the horizontal trip axis when an obstacle is encountered;

a vehicle push bar mount connected to a chassis of the vehicle;

a vehicle idler bar mount connected to a chassis of the vehicle and located at a different height with respect to the vehicle than the vehicle push bar mount;

a push bar having a first end pivotally secured to the vehicle push bar mount and a second end pivotally secured to the push bar mount on the plow frame structure;

an idler bar having a first end pivotally secured to the vehicle idler bar mount and a second end pivotally secured to the idler bar mount on the plow frame structure; and a lift mechanism that moves the push bar pivotally around the vehicle push bar mount, thereby moving the plow blade with respect to the chassis of the vehicle;

wherein the lift mechanism has sufficient range to push the plow blade downward with respect to a chassis of the vehicle so that a bottom cutting edge of the plow blade provides downward pressure against ground on which the vehicle is supported which is sufficient to at least partially unweight front wheels on the vehicle and transfer additional weight of the vehicle to rear wheels on the vehicle.

32. The plow system as recited in claim 31 wherein the V-plow system further comprises:

a first plow angle adjustment arm having a first end connected to a rear side of the first plow blade and a second end connected to the plow frame structure; and a second plow angle adjustment arm having a first end connected to a rear side of the second plow blade and a second end connected to the plow frame structure.

33. A plow system as recited in claim 32 wherein:

the connection between the first end of the first plow angle adjustment arm and the rear side of the first plow blade accommodates three dimensional rotation;

the connection between the second end of the first plow angle adjustment arm and the plow frame structure accommodates three dimensional rotation;

the connection between the first end of the second plow angle adjustment arm and the rear side of the second plow blade accommodates three dimensional rotation; and the connection between the second end of the second plow angle adjustment arm and the plow frame structure accommodates three dimensional rotation.

34. A plow system as recited in claim 32 wherein:

the connection between the first end of the first plow angle adjustment arm and the rear side of the first plow blade is a ball joint;

the connection between the second end of the first plow angle adjustment arm and the plow frame structure is a ball joint;

the connection between the first end of the second plow angle adjustment arm and the rear side of the second plow blade is a ball joint; and the connection between the second end of the second plow angle adjustment arm and the plow frame structure is a ball joint.

35. A V-plow system for a vehicle comprising:

a plow frame structure having a push bar mount;

a pair of plow blades connected along a vertical hinge and pivotally mounted to the plow frame structure at a plow blade mounting location for rotation about a horizontal trip mechanism;

a vehicle push bar mount connected to a chassis of the vehicle;

a push bar having a first end pivotally secured to the vehicle push bar mount and a second end pivotally secured to the push bar mount on the plow frame structure;

a trip mechanism including a freely rotatable hinge collar mounted around a hinge pin for the vertical plow hinge at a location higher than the plow blade mounting location, and a spring connected between the plow frame structure and the freely rotatable hinge collar to prevent rotation of the plow blades about the horizontal trip mechanism axis unless the plow blades encounter an obstacle; and a vertical hinge bracket connected to the pair of plow blades, the vertical hinge bracket having a flange containing a hole;

wherein the plow frame structure contains a hole corresponding to the hole in the vertical hinge bracket flange, and the system further includes a removable pin that can engage the hole in the plow frame structure and the hole in the flange to deactivate the trip mechanism and prevent rotation of the plow blades about the horizontal trip mechanism axis even when the plow blades encounter an obstacle.

36. A plow system for a vehicle comprising:

a plow frame structure having a push bar mount and an idler bar mount that is located at a different height on the plow frame structure than the push bar mount;

at least one plow blade mounted to the plow frame structure;

a vehicle push bar mount connected to a chassis of the vehicle;

a vehicle idler bar mount connected to a chassis of the vehicle and located at a different height with respect to the vehicle than the vehicle push bar mount;

a push bar having a first end pivotally secured to the vehicle push bar mount and a second end pivotally secured to the push bar mount on the plow frame structure;

an idler bar having a first end pivotally secured to the vehicle idler bar mount and a second end pivotally secured to the idler bar mount on the plow frame structure;

a lift mechanism that moves the push bar pivotally around the vehicle push bar mount, thereby moving the plow blade with respect to the chassis of the vehicle; and further wherein the push bar is part of a push bar structure including an actuator arm mount;

the actuator has an actuator arm connected to the actuator arm mount on the push bar structure;

the actuator arm contains an actuator arm hole;

the actuator arm is connected to the actuator arm mount on the push bar structure using a pin passing through the actuator arm hole and through the actuator arm mount on the push bar structure; and the actuator arm mount has an actuator arm pin hole that receives the pin to provide a fixed mount for the actuator to the plow frame structure and a vertical slot that receives the pin to provide a floating mount for the actuator to the plow frame structure.

37. A plow system for a vehicle comprising:

a plow frame structure having a push bar mount and an idler bar mount that is located at a different height on the plow frame structure than the push bar mount;

at least one plow blade mounted to the plow frame structure;

a vehicle push bar mount connected to a chassis of the vehicle;

a vehicle idler bar mount connected to a chassis of the vehicle and located at a different height with respect to the vehicle than the vehicle push bar mount;

a push bar having a first end pivotally secured to the vehicle push bar mount and a second end pivotally secured to the push bar mount on the plow frame structure;

an idler bar having a first end pivotally secured to the vehicle idler bar mount and a second end pivotally secured to the idler bar mount on the plow frame structure; and a lift mechanism that moves the push bar pivotally around the vehicle push bar mount, thereby moving the plow blade with respect to the chassis of the vehicle;

wherein the lift mechanism is an electrical DC actuator and the vehicle includes a steering assembly which a driver of the vehicle uses to steer the vehicle, and the plow system further comprises an automatic actuator control mechanism that is accessible by a vehicle driver steering the vehicle.

* * * * *